United States Patent [19]

Iizuka et al.

[11] Patent Number: 4,677,822

[45] Date of Patent: Jul. 7, 1987

[54] GAS TURBINE COMBUSTOR

[75] Inventors: Nobuyuki Iizuka; Katsukuni Hisano; Katsuo Wada; Masashi Kunihiro; Fumiyuki Hirose; Yoji Ishibashi; Isao Sato; Osamu Arai; Hiroshi Inose, all of Hitachi; Osamu Sakuda, Jyuoh, all of Japan

[73] Assignee: Hitachi, Ltd., Tokyo, Japan

[21] Appl. No.: 831,855

[22] Filed: Feb. 24, 1986

[30] Foreign Application Priority Data

Feb. 22, 1985 [JP] Japan ..... 60-32703

[51] Int. Cl.[4] ..... F02C 3/14

[52] U.S. Cl. ..... 60/39.23; 60/747

[58] Field of Search ..... 60/39.23, 733, 746, 60/747, 39.37

[56] References Cited

U.S. PATENT DOCUMENTS

| | | | |
|---|---|---|---|
| 2,655,757 | 10/1953 | Brown | 60/39.23 |
| 3,657,883 | 4/1972 | De Corso | 60/39.37 |
| 3,927,520 | 12/1975 | Arvin et al. | 60/39.23 |
| 3,930,368 | 1/1976 | Anderson et al. | 60/39.23 |
| 3,958,416 | 5/1976 | Hammond et al. | 60/39.23 |
| 4,112,676 | 9/1978 | De Corso | 60/733 |
| 4,497,170 | 2/1985 | Elliot et al. | 60/39.23 |
| 4,545,196 | 10/1985 | Mongia et al. | 60/733 |

FOREIGN PATENT DOCUMENTS

| | | | |
|---|---|---|---|
| 2065863 | 7/1981 | United Kingdom | 60/39.23 |

*Primary Examiner*—Louis J. Casaregola

*Attorney, Agent, or Firm*—Antonelli, Terry & Wands

[57] ABSTRACT

A gas turbine combustor having a head combustion chamber and a rear combustion chamber, with a plurality of air supply ports arranged in a circumferential wall of the rear combustion chamber, and a fuel nozzle. An outer cylinder forms a cylindrical air flow passage between the inner cylinder and the outer cylinder. A cylindrical control member is provided which is adapted to be movable in an axial direction for regulating an opening of the air supply ports. The control member is supported by a supporting means which is adapted to maintain a gap between the control member and the wall of the rear combustion chamber. The supporting member includes a flexible member for absorbing a deformation of the control member during the axial movement of the control member so that it is possible to prevent, if not avoid, mechanical wear on the control member and to reduce the $No_x$ concentration as well as obtain a highly reliable operation of the gas turbine combustor.

8 Claims, 9 Drawing Figures

GAS TURBINE COMBUSTOR

BACKGROUND OF THE INVENTION

The present invention relates to a gas turbine combustor, more particularly, to a gas turbine combustor having air flow rate control means which enables an improvement of the reliability of the combustor.

In, for example, Japanese Patent Laid Open Application No. 168821/1983, a low NOx combustor for a gas turbine is proposed having a regulation ring which is slidable in a circumferential direction of an inner cylinder of the combustor for controlling a primary air flow rate and a secondary air flow rate introduced into the inner cylinder in accordance with variations of the load to reduce concentrations of nitrogen oxides; however, a disadvantage of this proposed construction resides in the fact that the air flow rate regulation ring has a mechanical sliding part contacting an outer surface of the inner cylinder, and repetitive sliding operation wears out the regulation ring thereby making it difficult to exactly control the air flow rate in the inner cylinder.

A further disadvantage resides in the fact that the wear phenomenon on the regulation ring may result in premature formation of cracks therein, whereby a portion or part of the member of the regulation ring is broken or severed into small pieces or fragments which ultimately may be drawn or blown into the turbine connected to the downstream side of the combustor, thereby resulting in serious damage to the moving blade and stationary blades of the turbine.

The aim underlying the present invention essentially resides in providing a gas turbine combustor with an air flow rate control means, wherein an arrangement is provided for enabling an accurate control of the air flow rate entering a combustor and for providing an improved long term reliable operation of a gas turbine.

In accordance with advantageous features of the present invention, an air flow rate control arrangement is provided for properly maintaining the relationship between the combustor and movable parts thereof in a non-contacting manner thereby increasing the overall lifetime of the gas turbine.

In accordance with the present invention, a gas turbine combustor is provided which includes an inner cylinder forming a combustion chamber therein and a plurality of air supply ports in a circumferential wall member as well as a fuel nozzle. An outer cylinder forms a cylindrical air passage between the outer surface of the inner cylinder and the inner surface thereof, and a control means, having a flexible member, is provided for support thereof and is adapted to regulate the air flow rate supplied through the air supply ports when the gas turbine is operational.

By virtue of the features of the present invention, it is possible to improve the reliability of the gas turbine combustor with respect to a long-term operation of the gas turbine and to reduce the concentration of $NO_x$ throughout the entire load range of the gas turbine.

DETAILED DESCRIPTION

Figure 1:
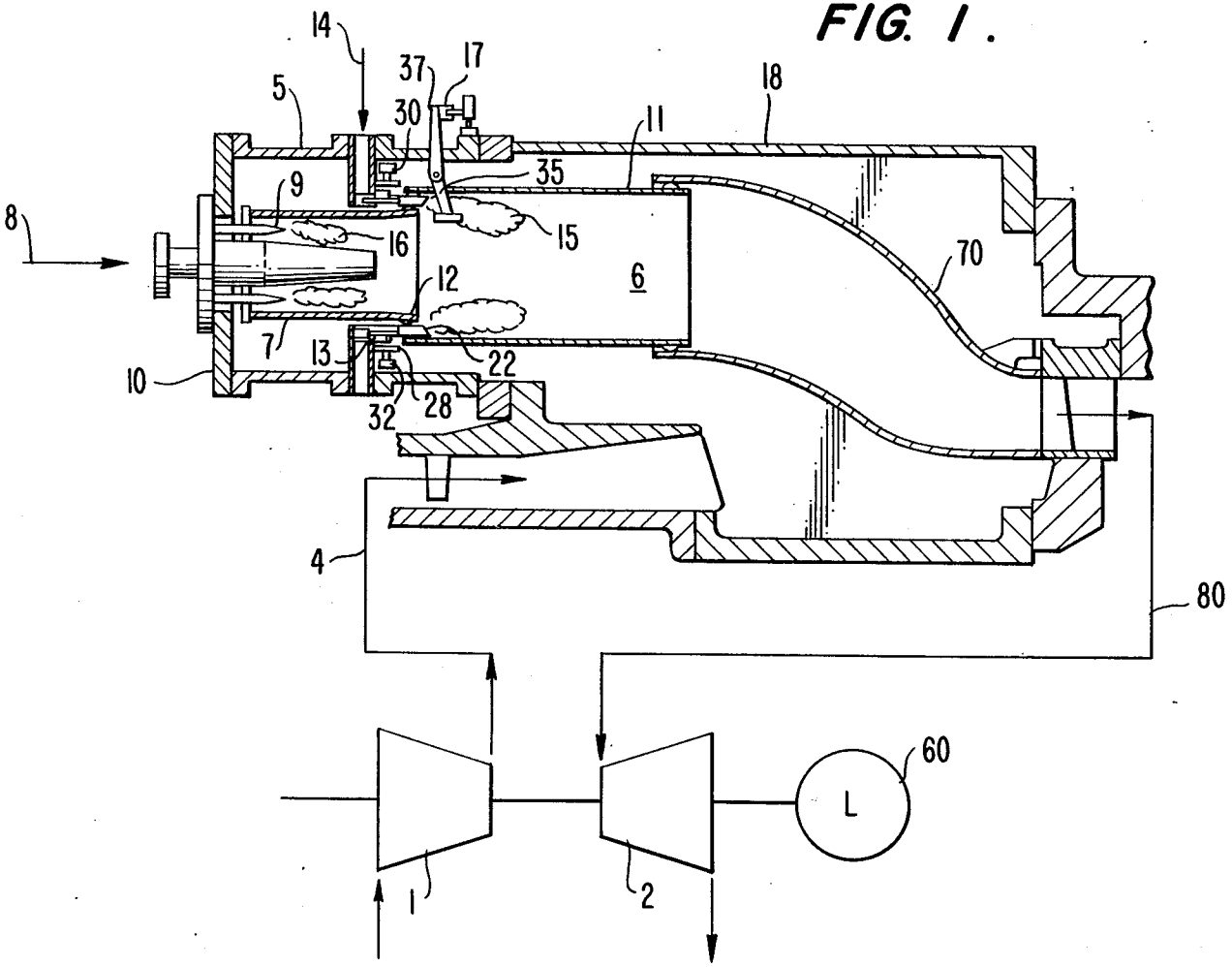
FIG. 1 is a cross-sectional view of a combustor of a two-step combustion system for gas turbines having an air flow regulating means constructed in accordance with the present invention.
Figure 2:
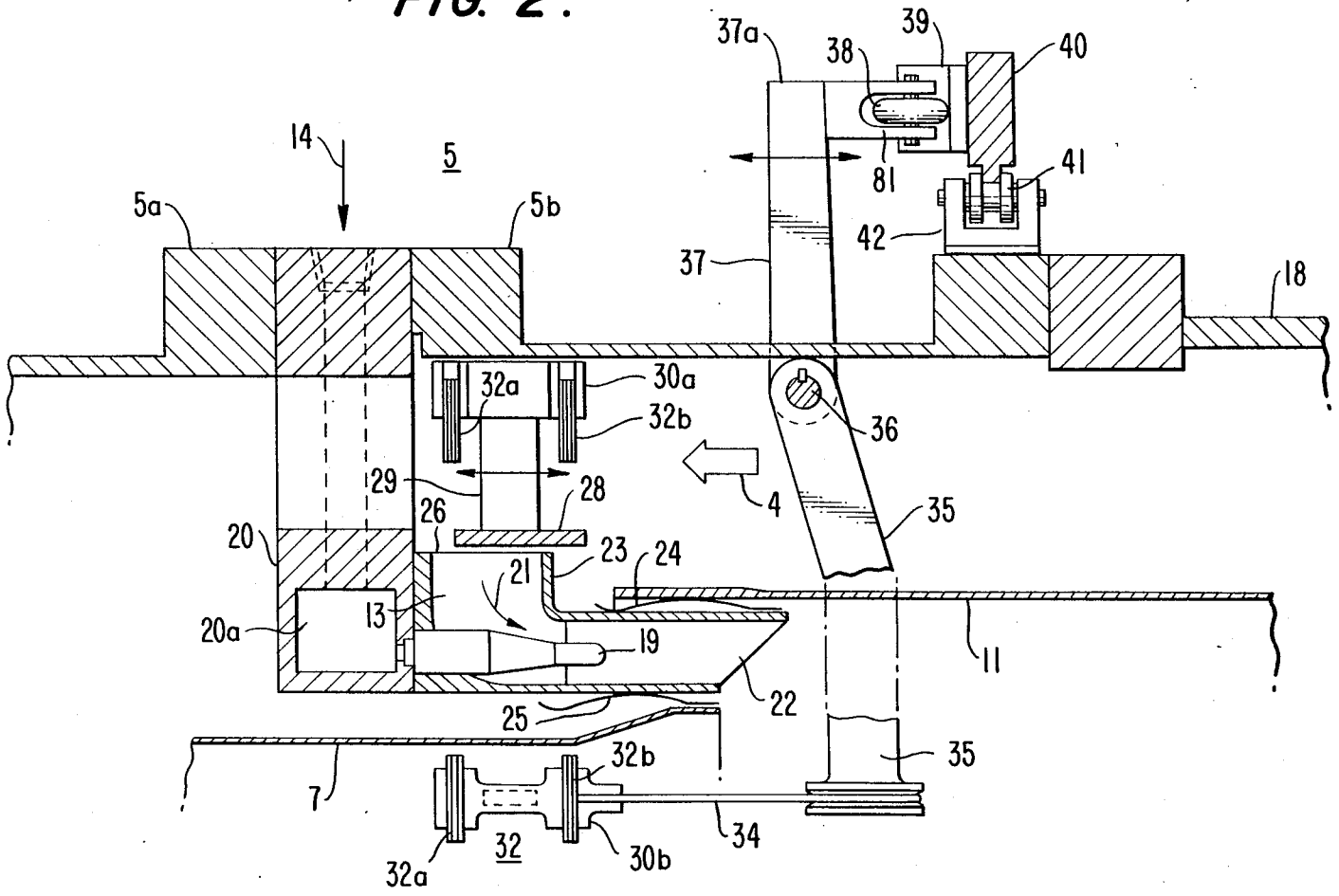
FIG. 2 is a cross-sectional view of the air flow rate regulation means of FIG. 1.

Referring now to the drawings wherein like reference numerals are used throughout the various views to designate like parts and, more particularly, to FIGS. 1 and 2, according to these figures, a gas turbine power plant includes a compressor 1 for compressing air, and a combustor generally designated by the reference numeral 3, of a two-step combustion system, mixes a fuel into the pressurized air 4 supplied from the compressor 1 and burns the fuel therein. A turbine 2 includes a plurality of stationary blades and movable blades driven by a high temperature and high pressure combustion gas 80 which is created or caused in the combustor 3. A load 60 such as, for example, a generator, is driven by the rotation of the turbine 2.

The air 4, compressed by the compressor 1, is introduced into the combustor 3 of the two-step combustion system, with the combustor 3 being provided with an outer cylinder generally designated by the reference numeral 5, an inner cylinder generally designated by the reference numeral 6, disposed coaxially with the outer cylinder 5, and an end cover 10 attached to the end of the outer cylinder 5 to which primary fuel nozzles 9, for supplying a primary fuel 8 into the head combustion chamber 7 formed interiorly of the inner cylinder 6, are fixed.

The inner cylinder 6 includes the head combustion chamber 7, and a rear cylindrical combustion chamber 11, a diameter of which is larger than that of the head combustion chamber 7. A joint portion between the head combustion chamber 7 and the rear cylindrical combustion chamber 11 is provided with an air supply port 13 into which a secondary fuel is injected.

The secondary fuel 14 is supplied, with the secondary air flowing through the air supply ports 13, into the rear cylindrical combustion chamber 11 to form a combustion flame 15 of a preliminary mixture in the rear combustion chamber 11. The combustion gas 80, generated in the rear combustion chamber 11, is introduced into the turbine 2 through a transition member 70. The primary fuel 8, injected from the primary fuel nozzles 9 attached to the head of the combustion chamber 7, is ignited by an ignition plug (not shown) to form a primary combustion flame 16 inside the head combustion chamber 7. The combustion flame 15 of the preliminary mixture, in an area of vicinity of the secondary air supply port 13, is formed due to the spreading or flaming out of the primary combustion flame 16. The combustor 3 is provided, at a circumferential portion thereof, with a link or connecting unit 17 which forms a driving means for carrying out the regulation which is necessary or peculiar to a two step combustion system of the flow rate of the air to be combusted or burnt.

As shown most clearly in FIG. 2, the control or regulate the flow rate of air to be combusted, the outer cylinder 5 is positioned at a front portion of the combustor casing 18, with the outer cylinder 5 including a front outer cylinder member 5*a*, a rear outer cylinder member 5*b*, and a flange 20 for introducing the secondary fuel from the outside of the outer cylinder 5 into the secondary fuel injection or ejection nozzles 19 in the interior to the outer cylinder 5. The flange 20 is fixed between the front and rear outer cylinder members 5*a*, 5*b*, with the flange being provided with a fuel passage so that the secondary fuel 14 flows into a plurality of second fuel nozzles 19 through a fuel manifold 20*a*, and with the secondary fuel nozzles being fixed to the flange 20. A secondary air supply unit generally designated by the reference numeral 23 is secured to the flange 20, with the air supply unit 23 being provided with a rotary member 22 so that the secondary fuel 14 injected from the secondary fuel injection nozzles 19 and the air to be combusted or burnt, which enters the air supply port 13, are intimately mixed.

A sealing spring 24 is provided on the outer circumferential surface of the secondary air supply unit 23, and a sealing spring 25 on the inner circumferential surface thereof. The rear combustion chamber 11, having a large diameter, is joined to the outer circumferential surface of the air supply unit by the sealing spring 24, and the head combustion chamber, having a smaller diameter, is joined to the inner circumferential surface of the air supply unit 23 by a seal member 25, with both the rear combustion chamber 11 and head combustion chamber 7 being supported on the flange 20.

An inlet port 26 of the secondary air supply unit 23 is opened with respect to the entire outer circumferential portion of the front end section thereof so that air and fuel can be uniformly supplied into the rear cylindrical combustion chamber 11. A control ring, for regulating the flow rate of the air 4 flowing from the compressor 1 into the inlet port 26 through the combustor casing 18, is provided on the outer side of the inlet port 26 in such a manner that the control ring 28 is maintained at a spacing from the inner circumferential surface of the inlet port 26 so as to provide a gap of a predetermined size between the outer circumferential surface of the inlet port 26 and the inner circumferential surface of the control ring 28. The control ring 28 is of a cylindrical configuration so as to cover the inlet port 26 for regulating the air flow rate flowing or supplied therethrough. A plurality of movable blocks 30*a*, 30*b* are provided at a top portion of a plurality of supports 29 disposed radially on an outer circumferential surface of the control ring 28. The positions of the movable blocks 30*a*, 30*b* are regulated in order to maintain a gap between the respective blocks and the inner surface of the outer cylinder at a predetermined distance. The number of blocks 30*a*, 30*b* respectively correspond to the number of supports 29.

Fixing blocks 31 (FIG. 3) are disposed or interposed among the movable blocks 30 in such a manner that the fixing blocks 31 alternate with the movable blocks 30*a*, 30*b* in a circumferential direction of the control ring 28. The fixing blocks 31 are firmly joined to the inner surface of the outer cylinder 5, with the fixing blocks 31 and movable blocks 30*a*, 30*b* being connected by laminated thin belt-like plate springs 32*a*, 32*b* so as to be arranged in a circular direction. The plate springs 32*a*, 32*b* are joined together with the movable blocks 30 and the fixing blocks 31 at the front and rear portions thereof along or in the longitudinal direction of the combustion chamber 11 so that a displacement, falling, or deformation of the control ring 28 can be absorbed by deflection of the plate springs 32*a*, 32*b* when the control ring 28 is axially displaced or moved.

Figure 3:
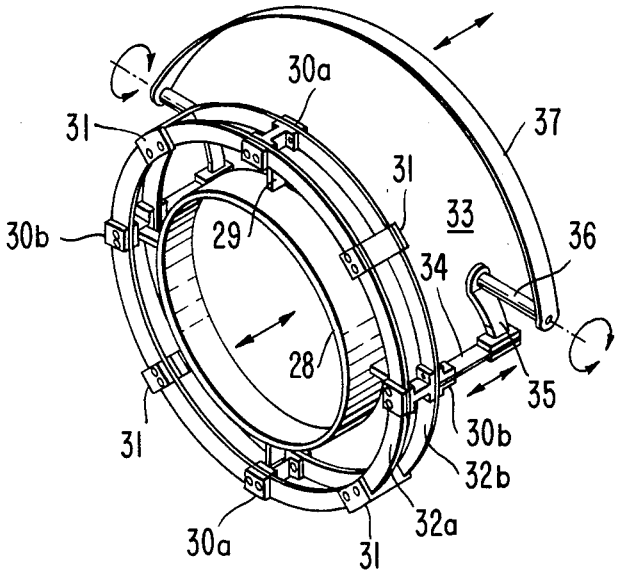
FIG. 3 is a perspective view of the portion of the air flow rate regulation means of FIG. 2.

As shown in FIG. 3, the cylindrical control ring 28 is fixed to an interior portion of the movable blocks 30*a*, 30*b* through a plurality of radially extending supports 29. The fixing blocks 31 are disposed between the movable blocks 30 so that the fixing blocks 31 and movable blocks 30 alternate in a circumferential direction of the control ring 28. The blocks 30*a*, 30*b* and 31 connect and support the thin belt-like laminated plate springs 32*a*, 32*b* in order to align the plate springs 32*a*, 32*b* at the same position with respect to the axial direction.

More particularly, the control ring 28 is installed in such a manner that the control ring 28 is set in a proper axial position with respect to the inlet ports 26 of the secondary air supply unit 23. Each of the fixing blocks 31 is, by mechanical connection, fixed to the inner surface of the outer cylinder 5, which is positioned on the outer side of the fixing blocks 31, in such a manner that each of the fixing blocks 31 are not moved in the axial and circumferential direction, respectively. The movable blocks 30*a*, 30*b* are positioned on the inner side of the outer cylinder 5 just as the fixing blocks 31. A height of the movable blocks 30*a*, 30*b* is regulated or adjusted in order to maintain a predetermined space between the movable blocks 30*a*, 30*b* and the inner surface of the outer cylinder 5. The movable blocks 30*a*, 30*b* are held in the space inside of the outer cylinder 5 by the plate springs 32*a*, 32*b* which extend among or between the fixing blocks 31, whereby the control ring 28 is held through the supports 29. The control ring 28 is maintained radially spaced with respect to an entire circumference thereof from the inlet port 26 of the secondary air supply unit 23 by a predetermined distance, so that the control ring 28 is prevented from contacting the inlet port 26. The driving unit 33 is connected to the left and right movable blocks 30*b* which are disposed at symmetrical positions with respect to an axis of the control ring 28.

As shown in FIG. 3, the driving unit 33 includes a thin belt-like plate spring 34, a lever 35, a shaft 36, a link 37, a roller 38, a cam 39, an operation ring 40, a roller 41, and a support 42. The link 37, shaft 36 and lever 35 are unitarily and mechanically combined by, for example, keys or bolts. When the link 37 is moved around the shaft 36 in an axial direction, the lever 35 is moved axially in a direction opposite to a moving direction of the link 37. The lever 35 is turned or pivoted around the shaft 36 in the same manner as the link 37. In order to convert the pivotal movement of the lever 35 into the axial movement, the plate spring 34 is provided which is horizontally connected between the lever 35 and the movable block 30*b*, with the plate spring 34 being adapted to be bent so as to absorb the displacement of the lever 35, which occurs while the lever 35 is turned, with respect to the block 30*b*, thereby making it unnecessary to use a complicated link mechanism.

Figure 4:
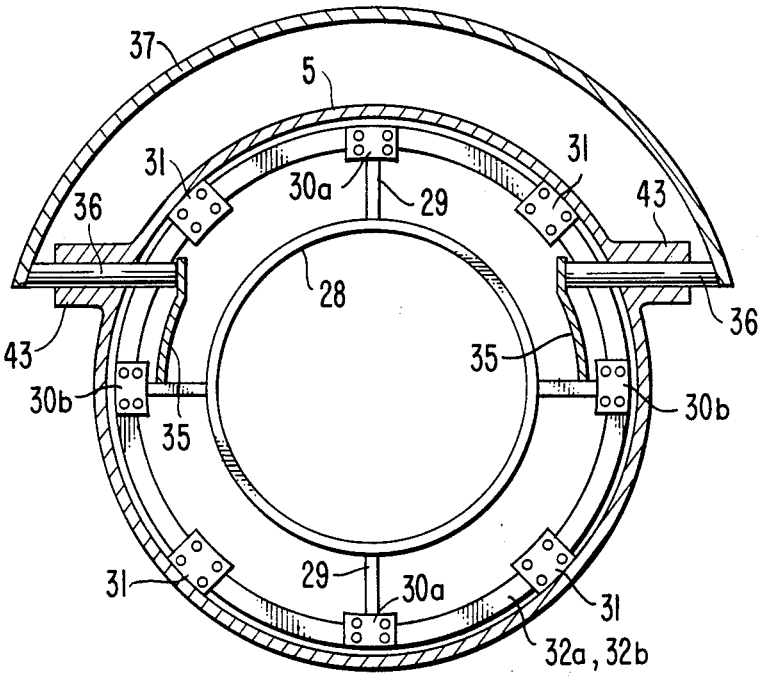
FIG. 4 is a cross-sectional detail view of a portion of the air flow rate regulation means of FIG. 2.

As shown most clearly in FIG. 4, the shaft 36 passes through a seat 43 projecting from an outer circumferential surface of the outer cylinder 5 so as to shut off or seal the interior of the outer cylinder 5 from the exterior thereof. The pressure of the air, especially in the interior of the outer cylinder 5, during an operation of the combustor becomes as high as about 10 kg/cm$^2$g, which is considerably higher than the atmospheric pressure in the exterior thereof, however, the outer cylinder 5 can be sufficiently sealed in spite of the clearance in each seat 43 that is large enough to merely enable the shaft 36 to turn therein.

Figure 7:
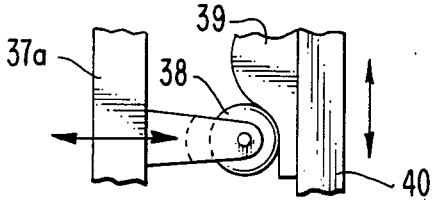
FIG. 7 is an upper elevational view of a portion of the drive mechanism of the air flow rate regulation means of FIG. 2.

As shown most clearly in FIGS. 2 and 7, the mechanism for moving the link 37 includes a roller 38, supported by a member 81 provided at a highest portion 37*a* or the link 37, with the roller 38 being engaged with a cam 39 having a convex and/or concave portion thereon which is provided on the operation ring 40 disposed on the outer surface of the outer cylinder 5. A plurality of rollers are provided on the inner circumferential side of the operation ring in order to enable a easy movement of the operation ring 40 in a circumferential direction thereof. When the operation ring 40 is moved or displaced by an appropriate drive mechanism in the direction of the double arrow A shown in FIG. 7, the roller 8 is pressed due to the shape of the cam 39 so that the link 37 is practically driven in the direction of the double headed arrow B shown in FIGS. 2 and 7. When the link 37 is thus moved, the lever 35 is turned to cause the movable blocks 30*b* to be displaced in an axial direction through a shifting of the plate springs 34, and the plate springs 32*a*, 32*b* to be bent uniformly with respect to the entire circumference thereof. As a result thereof, the cylindrical control ring 28, positioned in on inner side of the movable blocks 30*b* is moved axially and uniformly with respect to the whole circumference thereof.

Figure 5:
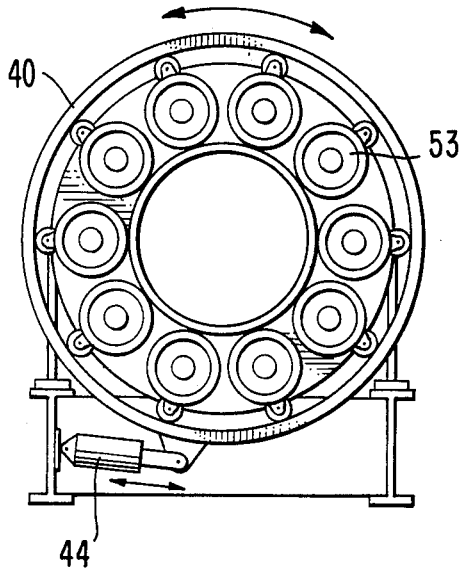
FIG. 5 is an external view of a combustor of a multi-cylinder system constructed in accordance with the present invention.
Figure 8A:
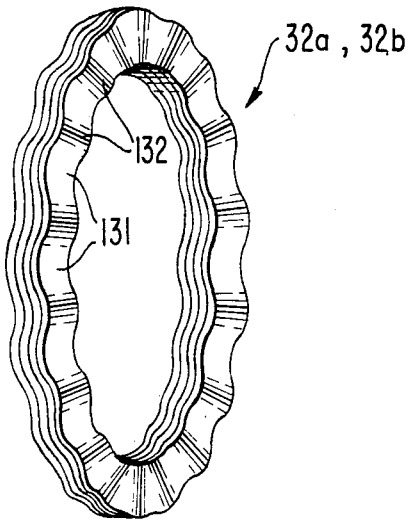
FIGS. 8A and 8B are respective perspective views of plate springs of the air flow rate regulation means of FIG. 2.
Figure 8B:
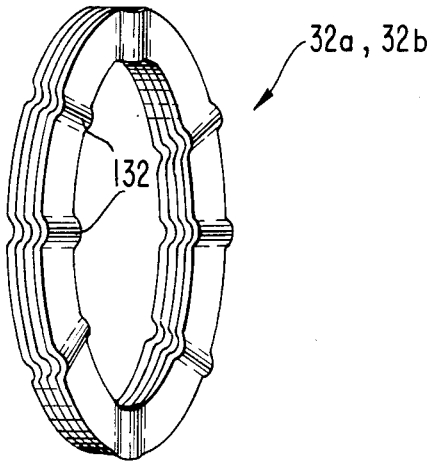

As shown most clearly in FIGS. 8A and 8B, the plate springs 32*a*, 32*b* are formed with convex portions 132 and/or concave portions 131 on some parts of the circular surface thereof in a manner similar to the shape of a wave so as to prevent a large tensile force from being applied thereto when the control ring 28 is axially moved. Accordingly, the plate spring 32*a*, 32*b* can be expanded and contracted in the circumferential direction thereof. Therefore, the flow rate of the air flowing from the secondary air supply unit 23 into the combustor through the inlet port 26 may be regulated to a uniform level with respect to the whole circumference of the inlet port 26. The cam 39 and roller 38 are always maintained in the same engaging conditions by the bending force of the plate spring 34 when the link 37 is pressed leftwardly in FIG. 2, and by the return force thereof when the link 37 is moved to the right. Generally, in many cases, a combustor in a gas turbine is provided with a multi-cylinder system and, while the above described embodiment relates to a combustor of a single cylinder system, even with a combustor of a multi-cylinder system, the same operation described above may be carried out in each combustor by turning an operation ring 40, extending around all of the combustors 53, by a hydraulic cylinder 44 as shown in FIG. 5.

Figure 6:
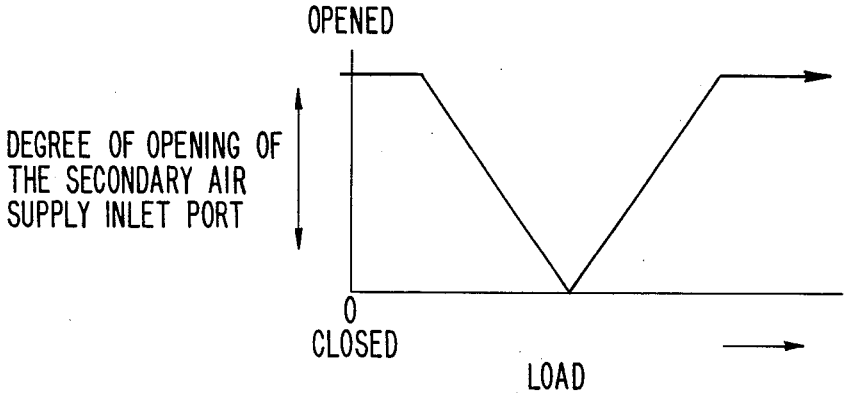
FIG. 6 is a graphical illustration of a relationship between an opening of the secondary air supply inlet port and a load of the gas turbine.

A normal operation of the control ring 40 is carried out in an intermediate load region illustrated graphically in FIG. 6 which shows a relationship between an opening of the secondary air supply inlet port and a load of the gas turbine. The control ring 40 is used in many cases, especially, when the flame spreads from the primary side to the secondary side in the two-step combustion system. Thus, in accordance with the gas turbine combustor of the present invention, the control ring 40 for regulating the flow rate of air entering into the combustor is supported in a non-contacting manner by the flexible plate springs, and is adapted to be removed or displaced, in practice in the positional relationship substantially identical with that of the control ring 40 in the installed state so that it is possible to improve the reliability of the long term operation of the gas turbine. That is, the movable part of the air flow rate control means of the gas turbine combustor may be set in a non-contacting state with respect to the fixed part thereof, and moved at the initial set condition thereof is substantially maintained. Moreover, the resilient force of the flexible plate springs are constantly exerted on the air flow regulating means so that a mechanical vibration of the regulating means cannot occur.

As evident from the above detailed description, the gas turbine combustor of the present invention enables a prevention of mechanical wear and damage to the air flow rate control means and enables an accurate control of the air flow rate into the combustor. Therefore, the constructional features of the present invention greatly contribute not only to improvements in the reduction of the concentration of $No_x$ throughout the entire load operation of the gas turbine but also in the reliability of the gas turbine combustor with respect to a long term operation of the gas turbine.

While we have shown and described several embodiments in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A gas turbine combustor including air flow rate control means, the combustor comprising:

an inner cylinder means for forming a combustion chamber means therein with an air supply port in a circumferential wall thereof; fuel nozzle means for supplying a fuel into the combustion chamber means; outer cylinder means provided along an exterior of the inner cylinder means for forming a space for air passage between an outer surface of the inner cylinder means and an inner surface of the outer cylinder means; control means provided on an outer side of the inner cylinder means and adapted to be movable substantially in an axial direction of the inner cylinder means for regulating the opening of the air supply port, said control means is cylindrically shaped and surrounds the air supply port in the combustion chamber means; flexible means for supporting the control means in order to maintain the gap between the control means and an exterior of the air supply port on the inner cylinder means and for allowing movement of the control means substantially in the axial direction of the inner cylinder means, said flexible means is circularly-shaped and has a larger diameter than a diameter of the control means and drive means for moving the control means substantially in the axial direction of the inner cylinder means; and wherein the flexible means is connected with the drive means through a second flexible means spaced in an axial direction of the inner cylinder means with respect to the first flexible means.

2. A gas turbine combustor including air flow rate control means, the combustor comprising: an inner cylinder means for forming a combustion chamber means with an air supply port in a circumferential wall thereof, the inner cylinder means is formed by a head combustion chamber and a rear combustion chamber having a larger diameter than a diameter of the head combustion chamber; fuel nozzle means for respectively supplying fuel to the head combustion chamber and the rear combustion chamber; outer cylinder means provided along an exterior of the inner cylinder means for forming a space for air passage between an outer surface of the inner cylinder means and an inner surface of the outer cylinder means; control means provided on an outer surface of the inner cylinder means and adapted to be movable substantially in an axial direction of the inner cylinder means for regulating the opening of the air supply port, said control means is cylindrically shaped and is disposed around an exterior of the air supply port provided on the rear combustion chamber; flexible means for supporting the control means in order to maintain the gap between the control means and an exterior of the air supply port on the inner cylinder means and for allowing a movement of the control means substantially in the axial direction of the inner cylinder means, said flexible means includes a plurality of laminated circular spring members, first blocks and second movable blocks are connected to each other by said circular spring members, the first blocks are fastened to the outer cylinder means and the second movable blocks are connected to an exterior of the control means through a plurality of support means disposed in a radial direction of the circular spring members; and drive means for moving the control means substantially in the axial direction of the inner cylinder means.

3. A gas turbine combustor as claimed in claim 2, wherein the laminated circular spring members have a wave-shape configuration defined by alternating concave and convex portions along at least a portion of a circumferential direction thereof for allowing a deflection in an axial direction thereof.

4. A gas turbine combustor for a two-step combustion system, the gas turbine combustor comprising:

an inner cylinder means forming a head combustion chamber and a rear combustion chamber having a larger diameter than a diameter of the head combustion chamber;

air supply port means disposed in a circumferential wall of the rear combustion chamber;

fuel nozzle means provided in the head combustion chamber for supplying a fuel into the inner cylinder means;

an outer cylinder means provided on an exterior of the inner cylinder means for forming a space defining an air passage between the outer surface of the inner cylinder means and an inner surface of the outer cylinder means;

a control means on the outer side of the cylinder means and adapted to be movable substantially in an axial direction of the inner cylinder means for regulating an opening of the air supply port means; and means for supporting the control means in order to maintain a gap between the control means and an exterior of the air supply port means including flexible members for absorbing a deformation of the control means by deflection thereof to allow movement of the control means substantially in an axial direction of the inner cylinder means, said supporting means comprises a plurality of laminated circular-shaped spring members.

5. A gas turbine combustor as claimed in claim 4, wherein the laminated circularly-shaped spring members are wave-shaped for allowing a deflection of the spring members in an axial direction thereof.

6. A gas turbine combustor as claimed in claim 4, wherein the laminated circular-shaped spring members have a wave-shape having alternating convex and concave portions along a circumferential direction thereof for allowing a deflection in an axial direction thereof.

7. A gas turbine combustor as claimed in claim 4, wherein the control means is disposed in the space for defining the air passage between the outer surface of the inner cylinder means and the inner surface of the outer cylinder means, said control means is cylindrically shaped and surrounds the air supply port means on the rear combustion chamber, and the flexible member is located in the space for defining the air passage and is of a circular shape having a larger diameter than a diameter of the control means.

8. A gas turbine combustor as claimed in claim 4, further comprising a compressor means for compressing air to be supplied to the combustor, and a turbine means driven by products of combustion produced in the combustor, and a load connected to the turbine means.

* * * * *